United States Patent [19]

Fridman et al.

[11] 3,978,704

[45] Sept. 7, 1976

[54] CONE SHELL MAKING MACHINE

[76] Inventors: Rudolf Naumovich Fridman, Zhemchuzhny proezd, 3, kv. 1; Mark Lvovich Katalkherman, ulitsa Kirova, 18, kv. 3; Sergei Petrovich Chistyakov, ulitsa Volodarskogo, 63, kv. 32, all of Penza, U.S.S.R.

[22] Filed: Aug. 1, 1975

[21] Appl. No.: 600,973

[52] U.S. Cl. ..... 72/303; 72/310

[51] Int. Cl.[2] ..... B21D 11/00; B21D 5/00

[58] Field of Search ..... 72/301, 303, 305, 311, 72/316, 319, 379, 310

[56] References Cited

UNITED STATES PATENTS

| | | | |
|---|---|---|---|
| 1,016,380 | 2/1912 | Wasson | 72/311 |
| 3,241,347 | 3/1966 | Seeloff | 72/301 |
| 3,597,956 | 8/1971 | Clausing | 72/309 X |
| 3,708,060 | 1/1973 | Natan | 72/379 |

FOREIGN PATENTS OR APPLICATIONS

| | | | |
|---|---|---|---|
| 817,023 | 7/1959 | United Kingdom | 72/301 |

*Primary Examiner*—Leon Gilden
*Attorney, Agent, or Firm*—Haseltine, Lake & Waters

[57] ABSTRACT

The machine according to the invention is intended for making cone shells by coiling up sheet blanks in the form of a circular sector. The machine comprises adjustable clamps for clamping the radial edges of the blank, said adjustable clamps being located on the base with a provision for turning towards each other with relation to their fixing point and for turning around their own longitudinal geometrical axis for which purpose the ends of the adjustable clamps are provided with hinges. Each adjustable clamp has also a device intended to prevent its turning around its own longitudinal geometrical axis. As a result, the machine can be used successfully for making cone shells with practically any coning angle.

9 Claims, 11 Drawing Figures

CONE SHELL MAKING MACHINE

The present invention relates to metal-working equipment and more particularly, to cone shell making machines.

The present invention can be utilized in chemical, petroleum, and other branches of machine and apparatus building involving the manufacture of cone-shaped apparatuses and their bottom heads, as well as in agriculture for manufacturing forage-storing facilities.

The invention can be used most successfully in making cone shells with comparatively thin walls, i.e., when the ratio of the wall thickness to the smaller diameter of the truncated cone of the shell is not over 0.045.

At present, the cone shells are made by widely known three-roll bending machines. In this case the blank has the form of a circular sector. In these machines one roll (usually the upper one) is inclined to the two other rolls in order to obtain a smaller bending radius on the smaller radius of the blank and a larger bending radius on the larger blank radius. However, by reason of the fact that the rolls are cylindrical in shape but the blank has the form of a circular sector there arises a difference between the relative velocities of the blank surfaces and rolls, i.e., the blank starts slipping. This leads to a considerable waet of the rolls and cocking of the blank in the plane perpendicular to the roll rotation plane so that at the end of the bending process the radial edges of the blank prove to be displaced relative to each other. Subsequent alignment of the blank edges is effected by straightening the blank which affects adversely the quality of the finished product.

In some cases the rolls are made tapered. However, such rolls can be employed only for making cone shells whose coning angle corresponds to that of the rolls; this restricts considerably the technological capabilities of such a machine.

Besides, the roll-type bending machines call for the use of special devices for holding up the blank, said device being arranged on both sides of the machine at the ends of the rolls. This is particularly necessary in the case of thin-walled blanks. The use of roll-type bending machines is possible only for making cone shells whose apex angle is not larger than 120°.

Presses belong to another type of machines widely used for making cone shells. However, the manufacture of shells with an apex angle exceeding 90° is possible on presses with a comparatively large table area because the shells are shaped when the punch moves along the cone axis. The manufacture of shells with an apex angle smaller than 90° calls for the use of special multiposition die sets which likewise reduces the technological capabilities of presses since each type-size of the shells has to be manufactured with the use of different tools.

Also known in the art is a machine for making cone shells by coiling sheet blanks in the form of a circular sector comprising a base to which are fastened by one end, practically in a common point, two adjustable clamps intended to clamp the radial edges of the blank, at least one of said adjustable clamps being installed with a provision for turning around its fastening point towards the other adjustable clamp in a plane parallel to the base, and a pusher located under the blank on the bisectrix of the angle of its sector with a provision for moving perpendicularly to the plane of the blank. This machine is used exclusively for making shells from blanks with a sector angle exceeding 180°.

As a rule, the adjustable clamps in the known machine are installed on a chuck plate. One adjustable clamp is fixed rigidly, while the other one is mounted on the chuck plate with a provision for turning around fastening point. At the initial moment of shell coiling after clamping the radial edges of the blank in the adjustable clamp the blank is acted upon by a pusher producing a force perpendicular to the surface of the blank for bringing the latter out of a stable flat position. Simultaneously, the chuck plate with the adjustable clamp secured to it is turned around the adjustable clamp fastening point while the other adjustable clamp is moved towards the first one at the same angular speed. At the final moment of blank coiling both adjustable clamps come practically to the line which is a continuation of the bisectrix of the blank sector angle. Thus, the blank is coiled by bringing together the adjustable clamps and, consequently, the radial edges of the blank.

The known machine is by far more efficient than a roll-bending machine or a press. Besides, the blank is out of contact with the parts of the machine in the course of coiling which rules out the possibility of damage to the blank surface.

However, the basic disadvantage of this machine lies in its restricted capabilities confining its use to making the shells from the blanks whose sector angle is larger than 180°. Besides, the mounting of the adjustable clamps calls for the provision of devices with a rotating chuck plate, e.g., a vertical lathe. The dimensions of the chuck plate govern the maximum length of the generating line of the cone shell. This leads to difficulties in making large shells.

The main object of the present invention resides in providing a machine for making cone shells wherein the design of the adjustable clamps and the method of their fastening in the machine would allow coiling the shells from blanks with practically any sector angle.

This object is accomplished by providing a machine for making cone shells by coiling sheet blanks in the form of a circular sector comprising a base to which are fastened by one end, practically in a common point, two adjustable clamps intended to clamp the radial edges of the blank, at least one of said adjustable clamps being installed with a provision for turning around its fastening point towards the other adjustable clamp in a plane parallel to the base, and a pusher located under the blank on the bisectrix of the angle of its sector with a provision for moving perpendicularly to the plane of the blank wherein, according to the invention, each adjustable clamp is installed on the base with a provision for turning around its geometrical axis for which purpose its ends are provided with hinges one of which is located in the fastening point of the adjustable clamp which has a device for fixing it after the turn, the pusher being installed with a provision for withdrawing it from the converging zone of the adjustable clamps.

Such a layout of the machine makes it possible to manufacture cone shells from blanks with a sector angle smaller than 180°. If the adjustable clamps can be fixed against turning around their own geometrical axes, the machine may be used for coiling shells from blanks with a sector angle exceeding 180°. Hence, the machine according to the invention can be used for making shells with practically any coning angle.

It is practicable that the hinge installed on the end of the adjustable clamp opposite to the fastening point should be installed on a carriage moving over a circular guide on the base.

The introduction of carriages allows both adjustable clamps to be moved simultaneously towards each other thus cutting down the time required for making one shell.

In one of the embodiments of the invention each adjustable clamp has a mechanism for turning it around the longitudinal geometrical axis at the beginning of the shell coiling process, said mechanism being made in the form of a rotatable hydraulic cylinder installed coaxially with the adjustable clamp and connected rigidly to the latter.

Such an arrangement used in coiling shells from blanks with a sector angle smaller than 180° makes it possible to overcome the resistance of the blank material which resists the turning of the adjustable clamps around their axes and to avoid bending of the blank edges in the direction opposite to the movement of the adjustable clamp carriages over the guide.

In another embodiment of the invention the ends of the adjustable clamps located opposite to their fastening point are provided with cams arranged square to their longitudinal geometrical axis in a "mirror image" manner; the profile of each cam has a rectilinear zone joining a rounded zone, the length of the rectilinear zone and the radius of the rounded zone being approximately equal to the height of the adjustable clamp.

Such cams assist in the turning of the adjustable clamps around their axis to the position in which the radial edges of the blank at the end of shell coiling process are aligned and joined.

It is also practicable that the pusher should be mounted on a floor trolley which is capable of moving along the bisectrix of the blank sector angle.

Such a mounting of the pusher allows it to be withdrawn from the adjustable clamp converging zone and provides for adjusting its position to suit the size of the blank.

In another embodiment of the invention each hinge located at the adjustable clamp fastening point on the base has a support of its own while the hinge located at the opposite end is mounted on the carriage with a provision for moving radially relative to the circular guide.

This method of fixing the adjustable clamp simplifies the unit and allows the hinges to be located in immediate proximity to one another. However, such an arrangement of the hinges calls for compensating motions of the adjustable clamp ends located opposite to said hinges. Therefore, the corresponding adjustable clamp hinges are mounted on a trolley with a provision for moving relative to it radially to the circular guide.

In still another embodiment of the invention the side surfaces of the floor trolley are provided with horizontally-turning levers intended to support the blank carried by said trolley.

Such a design of the trolley allows it to be used for bringing the radial edges of the blank to the adjustable clamps.

It is practicable that the circular guide should be sunk into a recess on the floor, flush with the latter.

This will provide for unobstructed movement of the floor trolley in the course of machine operation.

If the machine is used for making shells from blanks with a sector angle exceeding 180°, the adjustable clamps are locked against turning around their own axis. In this case they occupy such a position that the gap receiving the edges of the blank proves to be higher than it is when the adjustable clamps hold the blank with a sector angle smaller than 180°. Therefore, the part of the base opposite the adjustable clamp converging zone has a fixed ramp for the floor trolley.

Now the invention will be described in detail by way of example with reference to the accompanying drawings, in which.

Figure 1:
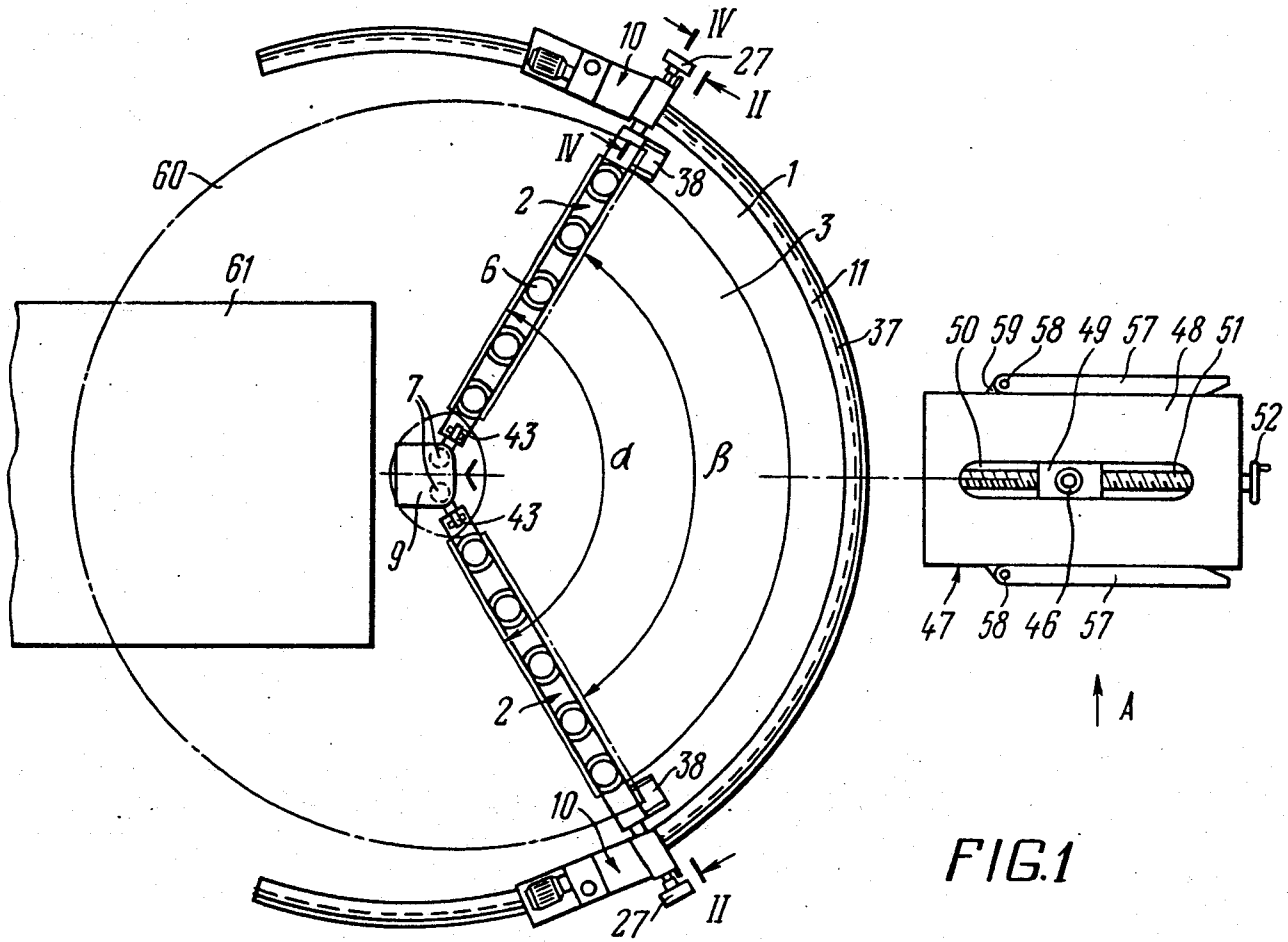
FIG. 1 is a plan view of the cone shell making machine according to the invention.

The machine according to the invention is designed for coiling cone shells from sheet blanks in the form of a circular sector. It comprises a base 1 (FIG. 1) mounted on which are two adjustable clamps 2 intended to clamp the radial edges of a blank 3. At one end the adjustable clamps 2 are secured to the base 1 practically in a common point.

Each adjustable clamp is made up of two parallel beams 4 and 5 set at a distance sufficient for inserting the edges of the blank 3 between them. At the side opposite to the fastening point of the adjustable clamps 2 on the base 1 the ends of the beams 4 and 5 are rigidly fastened to each other. The edges of the blank 3 are clamped by providing each adjustable clamp 2 with a number of hydraulic grips 6 arranged along the longitudinal geometrical axis of said clamp. It can be seen in FIG. 2 that before the beginning of the working cycle each adjustable clamp takes a position in which one beam 4 is located above the other beam 5. The term "longitudinal geometrical axis" of the adjustable clamp 2 should be understood as the geometrical axis of the upper (in the drawing) beam 4 which is a supporting beam. It this case the beam 5 is cantilevered.

Each adjustable clamp is provided at the ends with spherical hinges 7 and 8 (FIG. 2) whose centres lie on the longitudinal geometrical axis, said hinges ensuring the turning of the adjustable clamp 2 around said axis. The hinge 7 is made integral with a pivot **8*a* arranged along the longitudinal geometrical axis of the adjustable clamp 2 and is rigidly connected with it. The hinges 7 are located at the fastening point of the adjustable clamps 2 on the base 1. In this point each hinge 7 has a support of its own. Inasmuch as the supports of the hinges 7 should be as close to each other as possible, in the given example both supports are, essentially, sockets receiving the hinges 7; these sockets are made in an upright 9 installed on the base 1, approximately at the point of intersection of the longitudinal geometrical axes of the adjustable clamps 2. The upright 9 is separable in the plane of the longitudinal geometrical axis of the adjustable clamps 2**.

The hinge 8 of each adjustable clamp 2 is located in a carriage 10 which serves for turning the adjustable clamp 2 relative to its fastening point on the base 1 in a plane parallel to it in the course of operation of the machine. To ensure movement of the carriage 10, the machine comprises a circular guide 11 (FIG. 1) whose centre is located at equal distances from the centres of the hinges 7, said distances being equal to their centre-to-centre distance.

Figure 4:
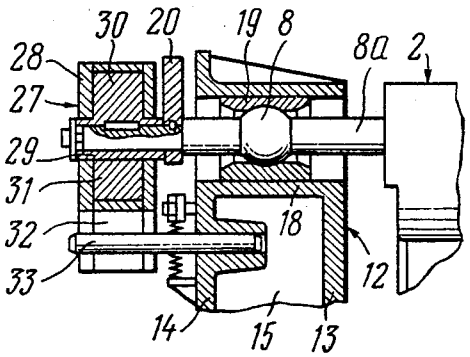
FIG. 4 is a section taken along line IV—IV in FIG. 1.
Figure 3:
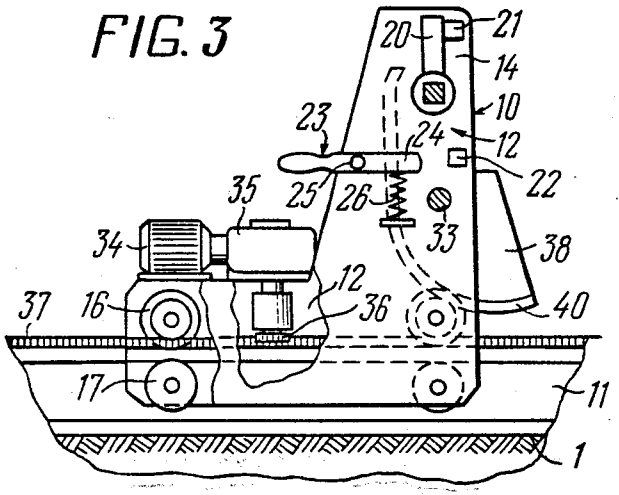
FIG. 3 is a section taken along line III—III in FIG. 2.

The carriage 10 comprises a body 12 (FIG. 3) formed by two vertical side walls 13 and 14 (FIG. 4) interconnected by ribs 15. Located one above the other in the lower part (in the drawing) of each of the side walls 13 and 14 are two rows of rollers 16 and 17 (FIG. 3) which fit around the upper (in the drawing) flange of the H-section guide 11. The rollers 16 of the upper row (in the drawing) are provided with flanges to prevent lateral displacement of the carriage 10 with respect to the guide 11. The side walls 13 and 14 of the carriage 10 have through holes interconnected by a bushing 18 (FIG. 4). The bushing 18 is installed square to the side walls 13 and 14 and accommodates a diametrically separable slide 19 which has a socket receiving the hinge 8. The slide 19 allows the hinge to move radially relative to the circular guide 11 (FIG. 1) during the movement of the carriage 10. The necessity for said radial movement is caused by the fact that the centres of the hinges 7, i.e., the points of fastening the adjustable clamps 2 on the base 1 fail to coincide with each other and, consequently, with the centre of the circular guide 11.

Each adjustable clamp 2 has a device for fixing it after turning relative to its longitudinal geometrical axis.

This device consists of a strap 20 (FIG. 3) secured rigidly on the end of the pivot 8*a* protruding beyond the body 12 of the carriage 10, two stops 21 and 22 secured on the external surface of the side wall 14, and a latch 23. The latch 23 has the form of a lever 24 installed with a provision for turning relative to the pivot 25 which is perpendicular to the wall 24. The end of the lever 24 located to the right (in the drawing) from the pivot 25 is loaded by a spring 26 fastened to the side wall 14. The lever 24 is located on the common horizontal straight line with the stop 22. Owing to the fact that in the manufacture of shells from blanks with a sector angle smaller than 180° there arises a moment opposing the turning of the adjustable clamps 2 around their longitudinal geometrical axes, each of the adjustable clamps 2 is provided with a mechanism for its positive turning. In the given example this mechanism consists of a rotatable hydraulic cylinder 27 (FIG. 24) whose casing 28 accommodates a vane 30 rigidly secured on a hollow shaft 29. Another vane 31 is rigidly secured to the inner surface of the casing 28. The hollow shaft 29 is set coaxially with the pivot 8*a*, being rigidly connected to the latter. The casing 28 adjoins an integrally made fork 32 which fits around a bar 33 which is arranged parallel with, and underneath the pivot 8*a* and is rigidly connected with the body 12 of the carriage 10. The vanes 30 and 31 divide the casing 28 of the hydraulic cylinder 27 into two spaces C and D (FIG. 5), each space communicating with a source (not shown) of a liquid under pressure.

To ensure movement of the carriages 10 over the guide 11 and their turning with the adjustable clamps 2 towards each other, each carriage 10 (FIG. 3) has a drive secured on the body 12 of the carriage 10. The drive consists of an electric motor 34 with a brake (not shown) and a speed reducer 35 whose vertical output shaft carries a gear 36 at the end, said gear meshing with a rack 37 secured on the guide 11.

Figure 5:
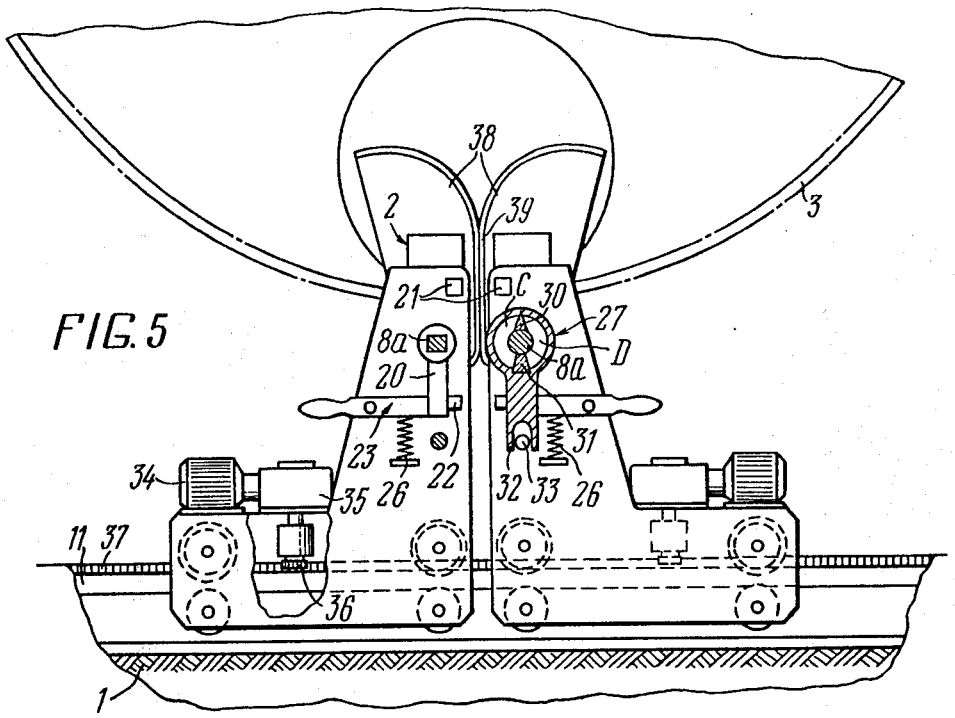
FIG. 5 shows the position of carriages at the moment of convergence of the adjustable clamps.
Figure 6:
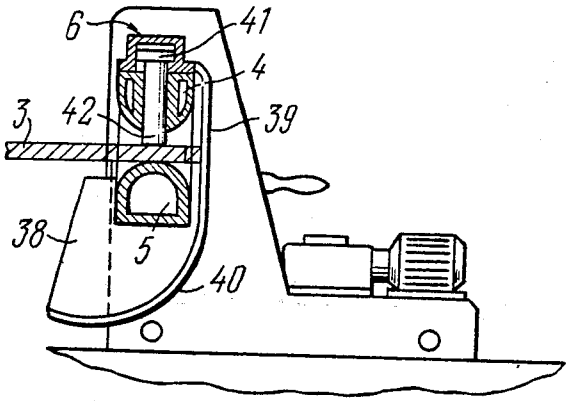
FIG. 6 is a section taken along line VI—VI in FIG. 2.

At the end of coiling the shell from a blank with a sector angle smaller than 180° the radial edges of the blank should be accurately aligned; therefore, the adjustable clamps should come at this moment to a position in which the longitudinal axes of both beams 4 and 5 forming one adjustable clamp 2 would lie in a vertical plane which is parallel to a similar plane passing through the longitudinal axes of both beams 4 and 5 of the other adjustable clamp 2. For this purpose the end of each adjustable clamp 2 farthest from the fixing point carries a cam 38 (FIG. 6). The plane of the profile of the cam 38 is perpendicular to the longitudinal geometrical axis of the adjustable clamp 2. The profile of each cam 38 is made up by a rectilinear zone 39 and a rounded zone 40 so that at the final moment of shell coiling the rectilinear zones of both cams 38 occupy a vertical position and come in contact throughout their length whereas their rounded zones are arranged in a "mirror image" manner relative to each other as shown in FIG. 5. The length of the rectilinear zone 39 of the profile of the cam 38 is selected to be approximately equal to the height of the adjustable clamp 2.

The radius of the rounded zone 40 is likewise approximately equal to the height of the adjustable clamp 2 while its centre is offset from the longitudinal geometrical axis of said clamp 2. In the given example the height of the adjustable clamp 2 should be understood as the distance measured vertically between the longitudinal geometrical axis of the adjustable clamp 2 (FIG. 6) and the downmost point of the beam 5.

Figure 2:
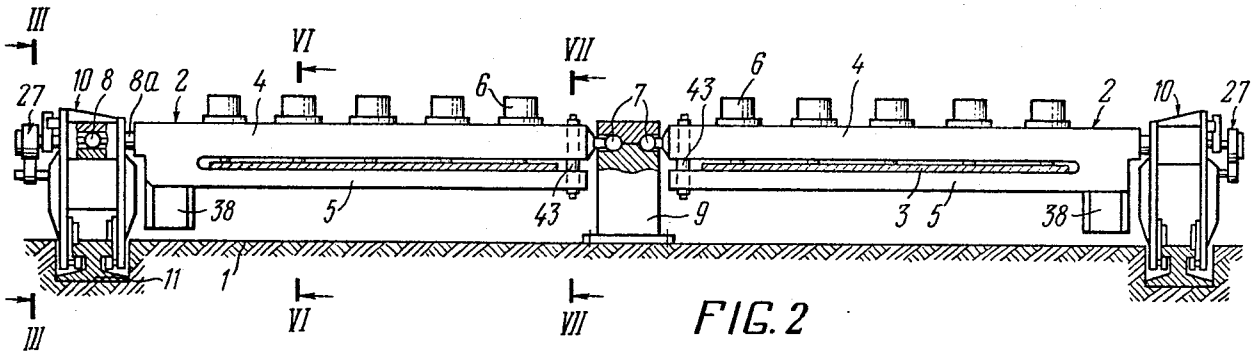
FIG. 2 is a section taken along line II—II in FIG. 1.
Figure 8:
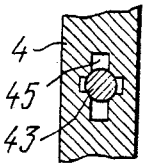
FIG. 8 is a section taken along line VIII—VIII in FIG. 7.
Figure 7:
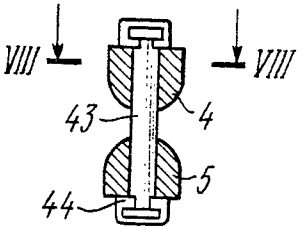
FIG. 7 is a section taken along line VII—VII in FIG. 2.

The blank 3 is clamped in the adjustable clamps 2 by hydraulic grips 6 (FIG. 2). Each grip 6 is constituted by a hydraulic cylinder built into the beam 4 (FIG. 6), the piston 41 of said cylinder being made integral with a rod 42. The end of the rod 42 stands out above the surface of the beam 4 facing the beam 5 so that the rods 42 of the hydraulic cylinders press the blank 3 against the lower (in the drawing) beam 5. Inasmuch as the cantilever beam 5 of the adjustable clamp 2 is subjected to a considerable bending moment during fixing of the blank 3, said beam is relieved and its strength is increased at the same dimensions of its cross section by providing a cylindrical bar 43 (FIG. 7) with radial projections 44 at the ends. The bar 43 is mounted in the beams 4, 5 of the adjustable clamp 2 in the holes whose surface is provided with longitudinal slots 45 (FIG. 8) to give way to said radial projections 44 on the bar 43. The distance between the projections 44 measured along the length of the bar 43 (FIG. 7) is equal to the sum of the heights of the beams 4 and 5 and the gap between them at the location of the bar 43.

While starting to coil up the shell, the flat blank 3 has to be brought out of its steady position by applying a force perpendicular to its surface at the point lying on the bisectrix of the blank sector angle.

Figure 9:
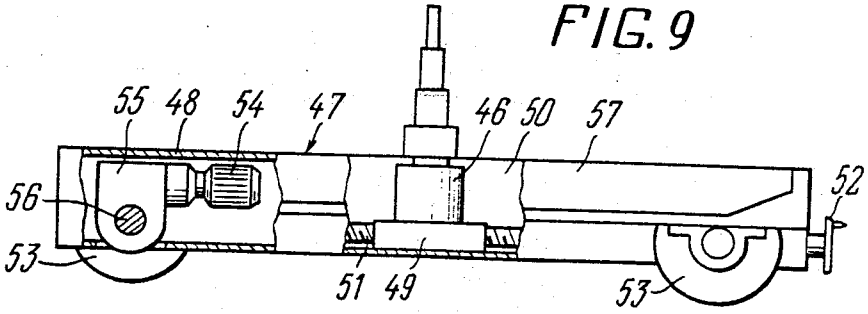
FIG. 9 is a side view of the floor trolley.

With this purpose in view the machine comprises a pusher 46 in the form of a telescopic hydraulic jack. In the given example the pusher 46 is mounted on a floor trolley 47 having a horizontal platform 48 (FIG. 9). The jack base is rigidly connected with a slide 49 accommodated in a slot 50 in the platform 48 of the trolley 47, said slot being arranged along the movement of the trolley 47 in the course of operation of the machine. The slide 49 has a threaded horizontal hole extending parallel to the slot 50 and accommodating a motion screw 51 installed on the trolley 47 and carrying a hand wheel 52 at the end. Thus, the pusher 46 is installed on the trolley 47 with a provision for moving along the bisectrix of the sector angle of the blank 3. Besides, the trolley 47 proper is also capable of moving in this direction for which purpose its platform 48 is mounted on wheels 43. The trolley 47 is provided with a drive consisting of an electric motor 54 with a brake (not shown) and a speed reducer 55 whose output shaft is connected mechanically with the axle 56 of the front pair of wheels 53 (in the direction of movement of the trolley 47). The R.H. pair of wheels 53 (in the drawing) can turn in a horizontal plane for steering the trolley 47.

The side surfaces of the platform 48 of the trolley 47 are provided with horizontally turning levers 57 whose pivots 58 (FIG. 1) are mounted in brackets 59 rigidly secured on the platform 48.

The levers 57 support the blank 3 carried on the platform 48 of the trolley 47 for inserting the radial edges of said blank 3 into the adjustable clamps 2. To assure free movement of the trolley 47, the circular guide 11 (FIG. 2) is sunk into a recess in the floor flush with the latter.

The machine according to the invention is also adapted for coiling cone shells from blanks 60 (FIG. 1) with a sector angle exceeding 180°. Such blanks 60 are inserted into the adjustable clamps 2 from the side opposite to the point of their convergence. This is done with the aid of the same trolley 47; however, since the cantilever beams 5 of the adjustable clamps 2 are in this case located above the supporting beams 4, the blank 60 has to be located higher than the blank 3. Therefore, the part of the base 1 opposite to the point of convergence of the adjustable clamps 2 has a fixed ramp 61 for the trolley 47.

Operating of the machine according to the invention will now be considered by describing the process of coiling a shell from a blank with a sector angle less than 180°. Before work, the levers 57 secured on the platform 48 of the trolley 47 are turned in a horizontal plane so that, together with the platform 48, they support the blank 3. The pusher 46 is arranged level with the platform 48 and is set by the screw 51 in the slot 50 of the platform 48 approximately opposite the centre of the radius of the blank 3, along the length of said radius. The trolley 47 is located beyond the limits of the circular guide 11. The adjustable clamps 2 are spread apart through an angle equal to the sector angle of the blank 3 and arranged symmetrically relative to the bisectrix of said sector angle of the blank 3. Each adjustable clamp 2 occupies a position in which the supporting beam 4 is located above the cantilever beam 5, the axes of the hydraulic cylinders of the grips 6 are vertical and the cylinder rods 42 are in the topmost position. The beams 4 and 5 of each adjustable clamp 2 are interconnected by the bar 43.

The machine operates as follows.

Switching-on the electric motor 54 installed on the trolley 47 sets in motion the front pair of wheels 53 via the speed reducer 55 and the axle 56. The trolley 47 moves together with the blank 3 along the bisectrix of the sector angle of the blank 3 towards the adjustable clamps 2. The trolley 47 with the blank 3 continues moving until the radial edges of the blank 3 enter the gaps between the beams 4 and 5 of each adjustable clamp 2 and come to a position in which they protrude beyond said adjustable clamps 2. The distance from the edge of the blank 3 to the longitudinal geometrical axis of the corresponding adjustable clamp 2 should be equal to half the distance between the centres of the hinges 7 on which the adjustable clamps 2 are fastened. After inserting the radial edges of the blank in the adjustable clamps 2, the blank edges are clamped by means of grips 6. For this purpose the above- piston spaces of the hydraulic cylinders of the grips 6 are filled with fluid under pressure, the pistons 41 with the rods 42 move down and press the blank 3 against the beams 5. After clamping the blank in the adjustable clamps 2 the fluid under pressure is fed into the hydraulic jack of the pusher 46 and into the C spaces of the rotatable hydraulic cylinders 27, and simultaneously the drives of the carriages 10 are turned on. As a result, the pusher 46 goes upward, lifting the centre of the blank 3, bringing it out of the steady flat position and determining the direction of its motion during its coiling into a shell. Simultaneously, rotation of the gear 36 meshing with the rack 37 of the guide 11 moves the carriages 10 towards each other over said guide, thereby turning the adjustable clamps 2 relative to the centres of the hinges 7 which serve as the fastening points of said adjustable clamps 2. As the fluid under pressure is fed into C spaces of the hydraulic cylinder 27, the vane 30 of each hydraulic cylinder 27 turns together with the hollow shaft 29 which is rigidly connected with the pivot 8a of the clamp 2. As a result, the adjustable clamps 2 turn towards each other around their longitudinal geometrical axes, thus coiling up the blank 3. After the blank 3 has been pushed out of its steady flat state and acquired the shape of an arch, the trolley 47 with the pusher 46 is brought outside the limits of the circular guide 11. The adjustable clamps 2 keep moving towards each other coiling up the blank 3 until its radial edges come together which marks the end of the shell-making process. In the process of coiling the blank 3 the fluid under pressure continues to be fed into C spaces of the hydraulic cylinders 27 until each adjustable clamp 2 turns around its longitudinal geometrical axis through 90° from the initial position after which the delivery of the fluid into the hydraulic cylinders 17 is stopped and further turning of the adjustable clamps 2 around their longitudinal axes is effected by the resilient forces of the material of the blank 3. As the carriage 10 of each adjustable clamp 2 is moving, the hinge 8 located in the socket of the slide 19 and, consequently, the pivot 8a rigidly connected with said hinge and the hydraulic cylinder 27 secured on said pivot move relative to the body 12 of the carriage 10, radially with respect to the circular guide 11. The fork 32 of the casing 28 of the hydraulic cylinder 27 slides along the bar 33 which is rigidly connected to the wall 14 of the body 12 of the carriage 10. This motion of the hinge 8 is performed because the centres of the hinges 7, i.e., the fixing points of the adjustable clamps 2, are set at a certain distance from each other and do not coincide with the centre of the circular guide 11.

At the end of the blank-coiling process, after the adjustable clamps 2 have turned through more than 90° around their own geometrical axes from the initial position, the cams 38 installed on said clamps in a "mirror image" manner come in contact with each other at one of the points on the rounded zones 40 of their profiles. As a result, during the further movement of the carriages 10 over the circular guide 11 of the adjustable clamp 2, the profiles of the cams 38 start rolling over each other and turn the adjustable clamps 2 around their longitudinal axes up to the moment when the rectilinear zones 39 of the cams 38 occupy a vertical position and come in contact throughout their length as shown in FIG. 5. This relative position of the cams 38 corresponds to a position of the adjustable clamps 2 in which the longitudinal axes of both beams 4 and 5 forming one clamp 2 lie in a vertical plane which is parallel to the vertical plane passing through the longitudinal axes of the beams 4 and 5 of the other adjustable clamp 2.

Figure 10:
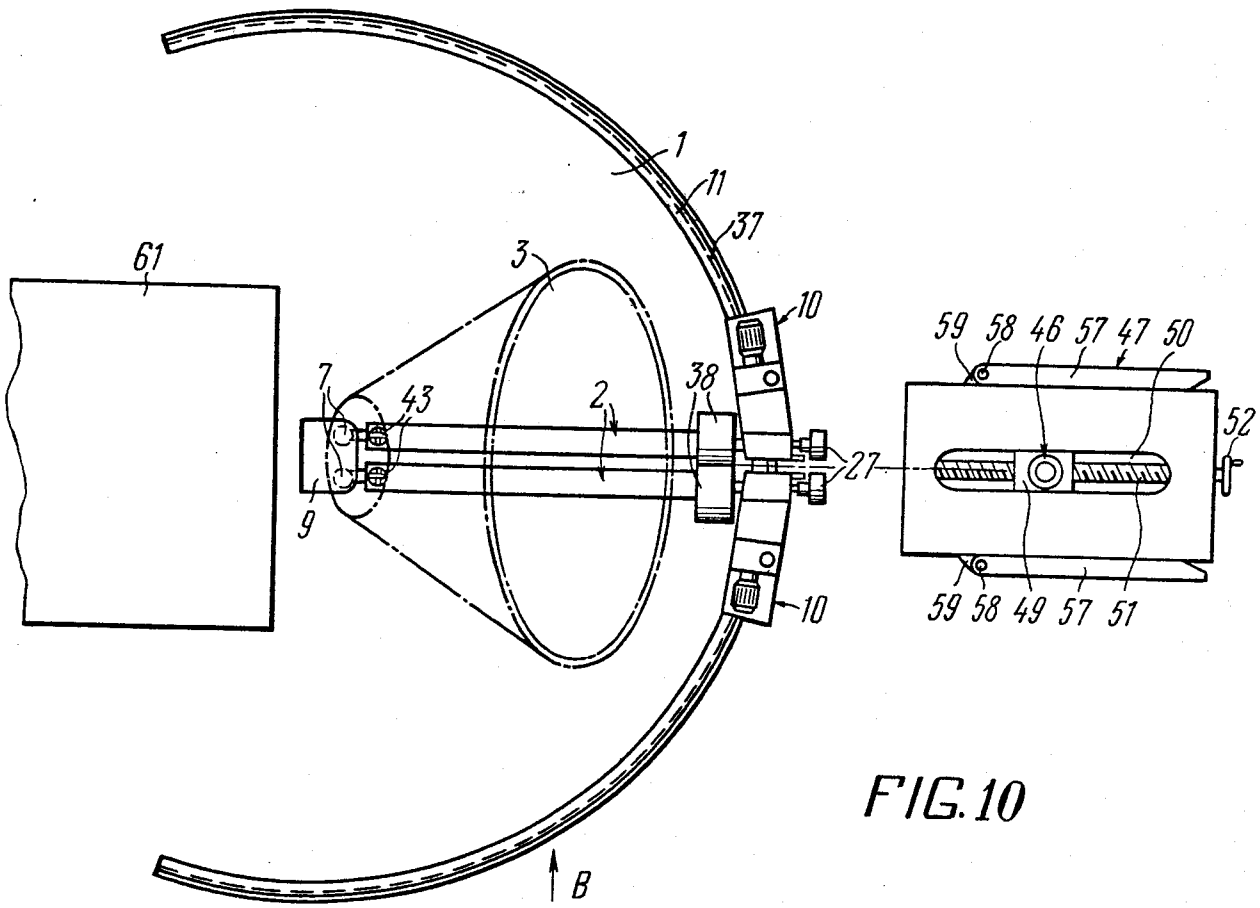
FIG. 10 is a plan view of the cone shell making machine on completion of the working cycle.
Figure 11:
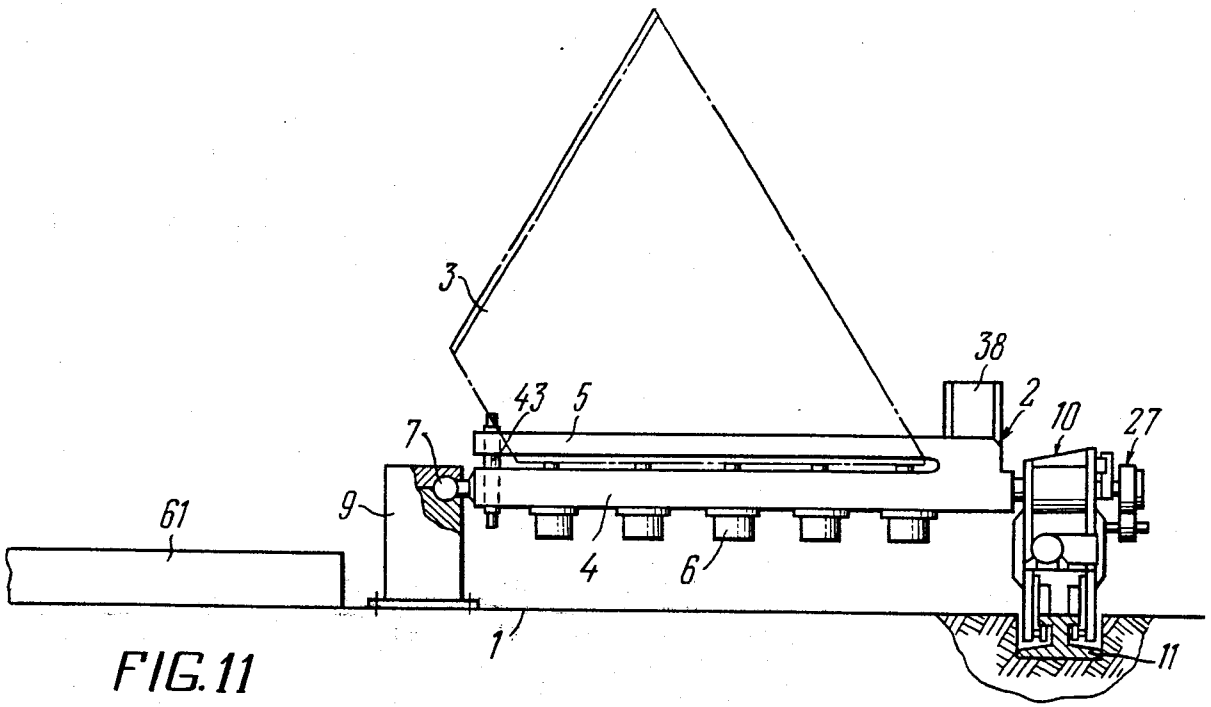
FIG. 11 shows the same as in FIG. 10, view along arrow B.

Before the end of coiling the blank 3 by turning each adjustable clamp 2 around its longitudinal geometrical axis the strap 20 of the adjustable clamp fixing device rigidly secured to said clamp presses by its end upon the end of the lever 24 of the latch 23, thereby compressing the spring 26 and turning the lever 24 around the pivot 25. At the moment when coiling of the blank 3 is finished, the strap 20 turning together with the adjustable clamp 2 occupies a vertical position and comes to bear against the stop 22. The lever 24 is released and turned by the spring 26 around the pivot 25, occupying a horizontal and fixing the strap 20 and, as a consequence, the adjustable clamp 2 against turning around its own axis. When the process of coiling up the blank 3 is completed, the electric motors 34 of the carriage 10 are cut off and the carriages 10 are braked to prevent their uncontrollable movement over the guide 11. The position of the adjustable clamp 2 and finished shell at this moment is shown in FIGS. 10 and 11. Then the radial edges of the blank 3 are welded together by a method which is considered best in each particular case. To remove the finished shell from the machine, the grips 6 are released for which purpose it is necessary to stop the delivery of fluid under pressure into the above-piston spaces of their hydraulic cylinders and to put said spaces in communication with the return line at the same time feeding fluid under pressure into the under-piston spaces. As a result, the pistons 41 with the rods 42 (FIG. 11) move upward and release the shell. Then the bars 43 are turned around their axes until their projections 44 get in line with the slots 45, the bars are removed from the holes in the beams 4 and 5 of the adjustable clamps 2 and the shell is removed from said clamps 2 with the aid of a hoisting device of any type.

The machine according to the invention is also adapted for coiling up shells from the blanks with a sector angle exceeding 180°. In this case the operating process of the machine is fundamentally the same as described above except for the following points. The trolley 47 is placed on the fixed ramp 61 and the blank is placed on its platform 48. As in the previous case the adjustable clamps 2 are arranged symmetrically with relation to the bisectrix of the sector angle of the blank 60. Using a rotatable hydraulic cylinder 27, each adjustable clamp 2 is brough to the position in which the cantilever beam 5 is located above the supporting beam 4 and fixed in said position by the latch 23. Fixing of the blank 60 in the adjustable clamps 2, bringing it out of the stable flat position, moving the carriages 10 over the guide 11, turning of the adjustable clamps 2 relative to the centres of the hinges 7 and all of the subsequent operations proceed along the same lines as described above. However, throughout the shell-coiling process, the adjustable clamps 2 are fixed against turning around their longitudinal geometrical axes. In addition, the trolley 47 must not necessarily be taken away from the fixed ramp 61 because in this case the trolley remains outside the movement and convergence zones of the adjustable clamps 2.

Thus, the machine according to the invention is adaptable for making cone shells from blanks with practically any angle of sector, i.e., for making shells with any coning angle.

We claim:

1. A machine for making cone shells by coiling sheet blanks in the form of a circular sector comprising: a base; two adjustable clamps secured at one end to said base in a common point and serving to clamp the radial edges of the blank; at least one of said adjustable clamps installed on said base with a provision for turning relative to its fixing point in a plane parallel to said base for moving towards the other one of said adjustable clamps; a pusher located under the blank on the bisectrix of its sector angle with a provision for moving perpendicularly to the plane of the blank and being withdrawn from the converging zone of the adjustable clamps; said two adjustable clamps, each installed on said base with a provision for turning around its longitudinal geometrical axis; hinges secured on the ends of each of said adjustable clamps, one hinge being secured at the point where the adjustable clamp is fixed to said base; a device for fixing each of said adjustable clamps against turning around its own longitudinal geometrical axis.

2. A machine according to claim 2 wherein the hinge located at the end of the adjustable clamp opposite to its fixing point is mounted on a carriage which moves over a circular guide located on the base.

3. A machine according to claim 1 wherein each adjustable clamp has a mechanism for turning it around its longitudinal geometrical axis at the beginning of coiling up the blank, said mechanism being formed by a rotatable hydraulic cylinder installed coaxially with the adjustable clamp and rigidly connected with the latter.

4. A machine according to claim 1 wherein the ends of the adjustable clamps opposite to their fixing point carry cams arranged perpendicularly to the longitudinal geometrical axis of said clamps in a "mirror image" manner, the profile of each cam having a rectilinear zone and an adjoining rounded zone, the length of the rectilinear zone and the radius of the rounded zone being approximately equal to the height of the adjustable clamp.

5. A machine according to claim 1 wherein the pusher is installed on a floor trolley with a provision for moving along the bisectrix of the sector angle of the blank.

6. A machine according to claim 2 wherein the circular guide is sunk into a recess in the floor, flush with the latter.

7. A machine according to claim 2 wherein each hinge located at the point where the adjustable clamp is secured to the base has a support of its own while the hinge located at the opposite end of the adjustable clamp is installed on a carriage with a provision for moving radially relative to the circular guide.

8. A machine according to claim 5 wherein the floor trolley has horizontally turning levers on its side surfaces for supporting the blank carried by said trolley.

9. A machine according to claim 8 wherein the part of its base opposite to the converging point of the adjustable clamps is provided with a fixed ramp for the trolley when the latter carries a blank with a sector angle exceeding 180°.

* * * * *